US005086305A

United States Patent [19]

Terasawa

[11] Patent Number: 5,086,305

[45] Date of Patent: Feb. 4, 1992

[54] LIQUID INJECTION RECORDING APPARATUS AND SUCTION RECOVERY DEVICE USING CAPPING MEANS INTEGRALLY PROVIDED WITH A PLURALITY OF CAPS

[75] Inventor: Koji Terasawa, Mitaka, Japan

[73] Assignee: Canon Kabushiki Kaisha, Tokyo, Japan

[21] Appl. No.: 636,568

[22] Filed: Jan. 7, 1991

Related U.S. Application Data

[63] Continuation of Ser. No. 488,444, Feb. 27, 1990, abandoned, which is a continuation of Ser. No. 157,148, Feb. 11, 1988, abandoned, which is a continuation of Ser. No. 847,233, Apr. 2, 1986, abandoned.

[30] Foreign Application Priority Data

| | | | |
|---|---|---|---|
| Apr. 5, 1985 | [JP] | Japan | 60-072176 |
| Jun. 4, 1985 | [JP] | Japan | 60-119833 |
| Jun. 4, 1985 | [JP] | Japan | 60-119834 |
| Jun. 4, 1985 | [JP] | Japan | 60-119835 |

[51] Int. Cl.[5] ..... B41J 2/165

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 4,394,669 | 7/1983 | Ozawa et al. | 346/140 R |
| 4,410,900 | 10/1983 | Terasawa | 346/140 R |
| 4,518,973 | 5/1985 | Tazaki | 346/140 |
| 4,533,927 | 8/1985 | Iwagami | 346/140 |
| 4,543,591 | 9/1985 | Terasawa | 346/140 |
| 4,558,326 | 12/1985 | Kimura | 346/140 X |
| 4,628,333 | 12/1986 | Terasawa | 346/140 |
| 4,631,554 | 12/1986 | Terasawa | 346/140 R |
| 4,631,556 | 12/1986 | Watanabe et al. | 346/140 R |
| 4,692,777 | 9/1987 | Hasumi | 346/140 |
| 4,695,851 | 9/1987 | Terasawa | 346/140 R |

FOREIGN PATENT DOCUMENTS

| | | |
|---|---|---|
| 56-113464 | 9/1981 | Japan . |
| 59-198161 | 9/1984 | Japan . |
| 0198160 | 11/1984 | Japan . |
| 2184066 | 6/1987 | United Kingdom . |

*Primary Examiner*—Joseph W. Hartary

*Attorney, Agent, or Firm*—Fitzpatrick, Cella, Harper & Scinto

[57] ABSTRACT

In a suction recovering device used in a liquid injection recording apparatus having a cap integrally provided with a plurality of caps, each for hermetically sealing the circumference of the orifice of a liquid injection recording head each cap communicating with suction and vent means, the cap is formed of an elastic material and atmosphere communicating means is provided for communicating the interior of the cap with the atmosphere immediately before the circumference of the orifice is hermetically sealed by the cap.

49 Claims, 9 Drawing Sheets

LIQUID INJECTION RECORDING APPARATUS AND SUCTION RECOVERY DEVICE USING CAPPING MEANS INTEGRALLY PROVIDED WITH A PLURALITY OF CAPS

This application is a continuation of application Ser. No. 07/488,444 filed Feb. 27, 1990, which in turn is a continuation of application Ser. No. 07/157,148, filed Feb. 11, 1988, now abandoned, which in turn is a continuation of application Ser. No. 06/847,233, filed Apr. 2, 1986, now abandoned.

BACKGROUND OF THE INVENTION

1. Field of the Invention

This invention relates to a liquid injection recording apparatus and a suction recovering device used in the apparatus.

2. Related Background Art

Liquid injection recording apparatus is generally called an ink jet printer and is provided with a recording head reciprocally movable along recording paper. Liquid is injected from the orifice of the recording head to form flying liquid droplets which are used to effect recording.

When bubbles mix into a liquid flow path provided in the recording head of the liquid injection recording apparatus of this type to clog the orifice at the end of the liquid flow path or the vicinity thereof, the carriage is positioned at a predetermined position which is not opposed to the recording surface, for example, a home position, and recording liquid (hereinafter referred to as ink) is sucked from the orifice portion by a suction recovering device provided on the apparatus side at said position to thereby eliminate the bubbles or the clogging.

Such a suction recovering device has a cap for covering the orifice portion of the recording head, and this cap and a pump are connected together by a tube and, by driving the pump, ink is sucked from the orifice portion by negative pressure.

In such a suction recovering device, however, the cap is designed to hermetically seal the orifice portion and therefore, during the hermetic sealing, the pressure in the cap increases to cause retraction of the meniscus of the ink in the orifice which in turn causes unsatisfactory discharge.

To eliminate such unsatisfactory discharge, ink must always be sucked in the cap, and this leads to wasting ink.

So, a cap provided with an atmosphere communicating mechanism has been proposed and a structure is adopted in which the interior of the cap is communicated with the atmosphere during the capping and the communication with the atmosphere is broken during the suction.

Even in such a structure, however, in the case of manual operation, the operator may forget to open the portion communicated with the atmosphere, and this has led to a problem that during the next capping operation, unsatisfactory discharge is caused by the retraction of the meniscus of the ink in the orifice.

In addition to such problem, in the above-described suction recovering device according to the prior art, excess ink covers and adheres to the orifice portion when ink is sucked from the orifice portion by negative pressure and during ink discharge, the presence of such adhering ink causes very unstable discharge.

It has also been proposed to provide an ink absorber in the cap and urge this absorber against the portion in which the orifice is disposed, to thereby suck and eliminate the adhering ink. However, if such a structure is adopted, there will occur the possibility of air being forced back into the orifice, which will further result in displacement of dust adhering to the absorber toward the orifice portion, which in turn will rather cause unsatisfactory discharge.

Also, the recording medium may be stained by excessive ink during the opening of the cap.

Further, in the suction recovering device, during the initial supply of ink and during the supply of ink when the ink tank has become empty, the ink suction operation positively directs the ink to the recording head side and therefore, unlike the normal discharge recovery time, a great amount of ink is sucked.

In order to increase the amount of ink sucked during such initial supply of ink, the suction pump has been of a great capacity, but this has also led to a disadvantage that the suction mechanism becomes so bulky as to prevent the device from being compact and the amount of ink sucked during the normal recording is so great as to cause wasting ink.

SUMMARY OF THE INVENTION

It is an object of the present invention to provide a liquid injection recording apparatus which solves the above-noted problems peculiar to the apparatus according to the prior art and a suction recovering device used in such apparatus.

It is another object of the present invention to provide a liquid injection recording apparatus provided with a suction recovering device having a cap for hermetically sealing the circumference of the orifice of a liquid injection recording head, said cap being formed of an elastic material, said apparatus having communicating means for communicating the interior of the cap with the atmosphere immediately before the circumference of the orifice is hermetically sealed by said cap.

It is still another object of the present invention to provide a liquid injection recording apparatus provided with a suction recovering device for hermetically sealing the circumference of the orifice of a liquid injection recording head by a cap and effecting the suction recovery of recording liquid by negative pressure, the apparatus being provided with operating means for operating negative pressure generating means generating the negative pressure when said cap is fitted to said liquid injection recording head.

It is yet still another object of the present invention to provide a suction recovering device for hermetically sealing the circumference of the orifice of a liquid injection recording head by a cap and effecting the suction recovery of recording head by negative pressure, the device being provided with operating means for operating negative pressure generating means generating the negative pressure when said cap is fitted to said liquid injection recording head.

It is a further object of the present invention to provide a suction recovering device used in a liquid injection recording apparatus wherein the circumference of the orifice of a liquid injection recording head is hermetically sealed by a cap and the suction recovery of recording liquid is effected by negative pressure, said device being provided with control means for controlling the amount of negative pressure generated.

It is still a further object of the present invention to provide a suction recovering device for a liquid injection recording apparatus in which during normal state including the ON and OFF states of the power source of the apparatus body, the circumference of the orifice of a recording head is not hermetically sealed but capped in the atmosphere-communicated state to thereby prevent air from being forced into the recording head and stabilize the quality of printing.

BRIEF DESCRIPTION OF THE DRAWINGS

FIG. 3 is a partly broken away plan view of an electromagnetic valve device.

DESCRIPTION OF THE PREFERRED EMBODIMENTS

First Embodiment

Figure 1:
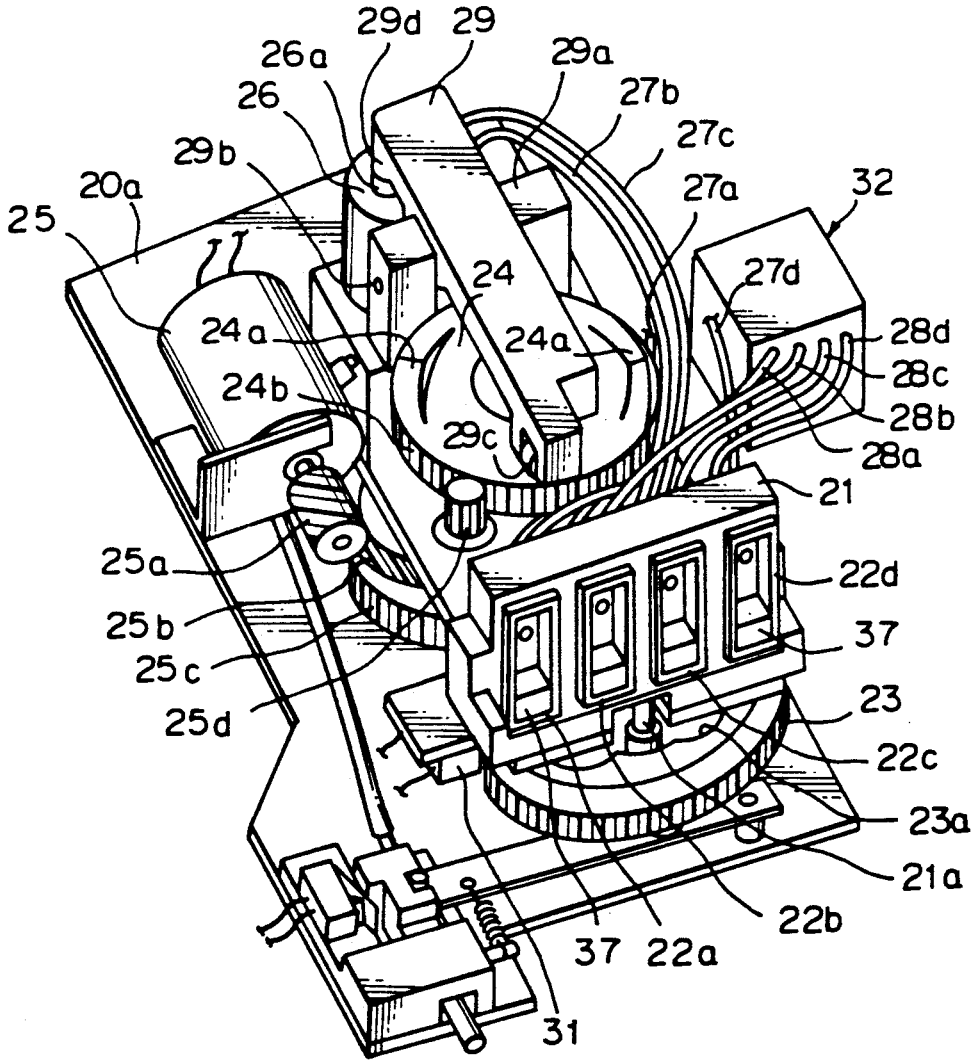
FIGS. 1 to 3 illustrate an embodiment of the present invention, FIG. 1 being a perspective view of a suction recovering device, FIG. 2 being a perspective view of the essential portions of a recording apparatus.
Figure 2:
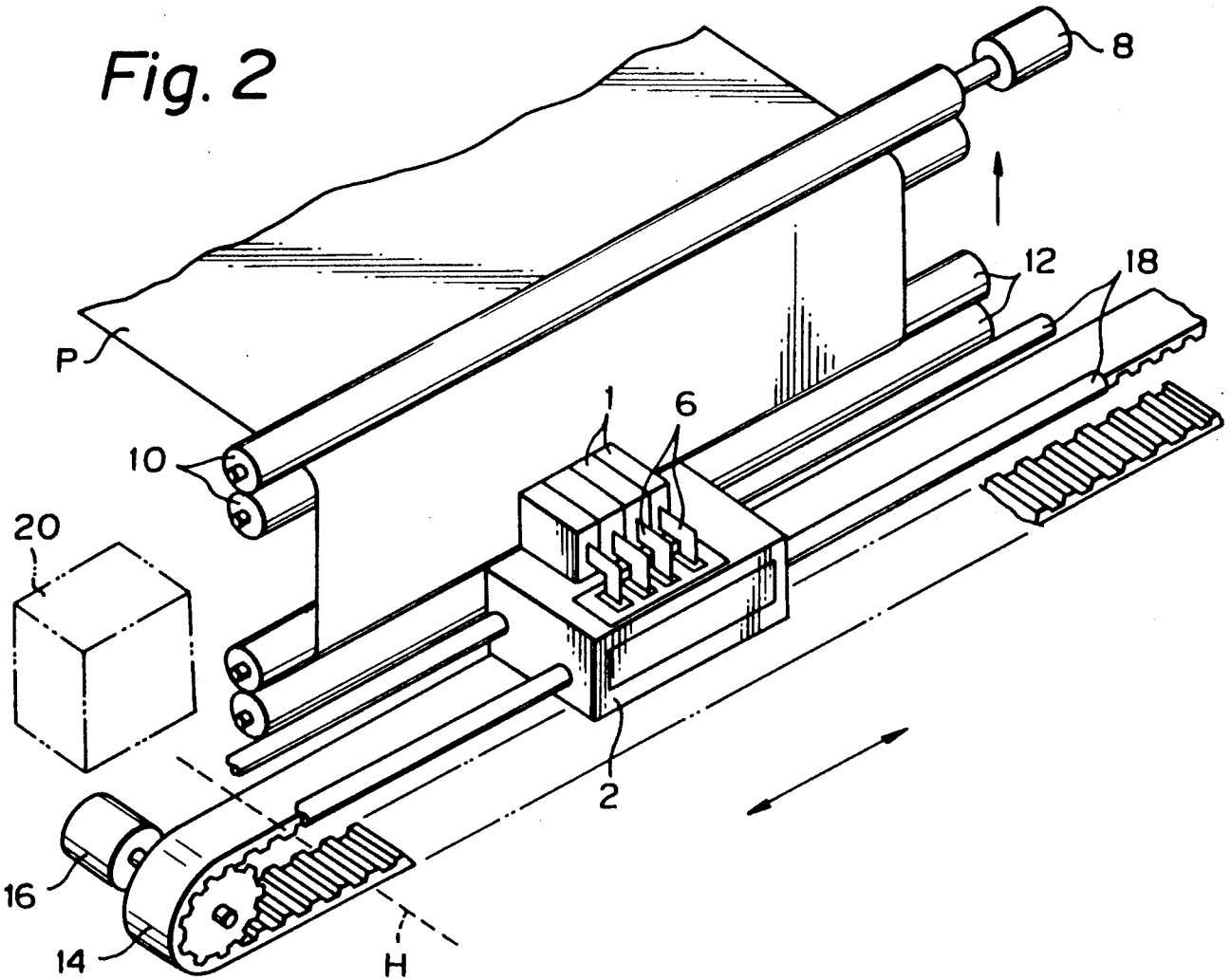
Figure 3:
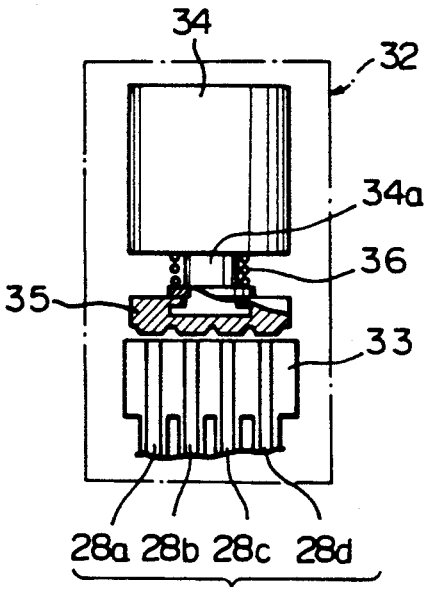

FIGS. 1 to 3 illustrate an embodiment of the present invention, and in FIG. 2, there is shown an example of the liquid injection recording apparatus to which the present invention is applied.

In FIG. 2, reference numeral 1 designates recording heads each having an ink storing portion for storing therein ink supplied from an ink supply source, a flow path for injecting the stored ink and an orifice formed at the end of the flow path, and provided with energy generating means for injecting the ink, for example, an energy converting member comprising a piezoelectric element which is an electro-mechanical converting members or a heat-generating resistance member which is an electro-mechanical converting members.

The number of the recording heads 1 is one in the case of monochromatic recording, but is four, for example, in conformity with the colors of ink in the case of color recording.

These recording heads 1 are mounted on a carriage 2 which is provided for sliding movement along two guide shafts 18.

The recording heads 1 and the carriage 2 are connected together by flexible cables 6 through which a control signal is supplied to the recording heads.

The carriage 2 is fixed to the intermediate portion of an endless belt 14 which is driven by a motor 16 to reciprocally move the carriage 2.

Two sets of rollers 10, 10 and 12, 12 are provided in parallelism to the guide shafts 18 and in opposed relationship with the carriage 2, and recording paper P is guided between these rollers.

A paper feeding motor 8 is fixed to one end of one of the rollers 10 to feed the recording paper P.

On the other hand, a suction recovering device 20 is provided at a home position indicated by H.

This suction recovering device 20 is of a structure as shown in FIGS. 1 and 3.

That is, the suction recovering device 20 is assembled with a base plate 20*a* as a standard, and a motor 25 is fixed to a portion thereof.

A pinion gear 25*a* fixed to the output shaft of the motor 25 is in mesh engagement with a gear 25*b*, and a pinion gear, not shown, which is integral with the gear 25*b* is in mesh engagement with a gear 25*c*.

A pinion gear 25*d* fixed to the rotary shaft of the gear 25*c* is in mesh engagement with a gear 24.

Two trapezoidal cams 24*a* circumferentially spaced apart from each other by a predetermined angle are projectedly provided on the upper surface of the gear 24.

Designated by 29 is a pump lever having its intermediate portion pivotally supported on a support frame 29*a* through a shaft 29*b*, the support frame 29*a* being projectedly provided on a base plate.

One end of the pump lever 29 is provided with a roller 29*c* for riding onto the cams 24*a* projectedly provided on the gear 24 and the other end of the pump lever 29 is in contact with the piston 26*a* of a pump 26 through a projection 29*d*.

This piston 26*a* is normally biased into its extended position by a spring provided in the pump to normally bring the roller 29*c* into contact with the gear 24.

Denoted by 21 is a cap holder to which are fixed a plurality of caps 22*a*–22*d* formed of an elastic material such as rubber.

Each of the caps 22*a*–22*d* is provided with an ink absorber 37 below the inner side thereof, and these caps are discretely connected to the pump 26 through tubes 27*a*–27*d*.

The cap holder 21 is slidably provided on the base plate 20*a* and is normally biased away from the pump 26 by a spring, not shown.

A gear 23 is rotatably journalled to the underside of the cap holder 21.

An inner face cam 23*a* is formed on the upper surface of the gear 23, and a shaft 21*a* projected from the lower end of the cap holder 21 is in contact with the inner face cam 23*a* through a roller.

Accordingly, the cap holder 21 repeats the operation of being pushed back toward the pump 26 by the protruding portion of the cam 23*a* with rotation of the gear 23.

The position of the cap holder 21 is detected by a switch 31.

On the other hand, the caps 22*a*–22*d* have ink sucking tubes 27*a*–27*d* and vent tubes 28*a*–28*d*.

Each of the vent tubes 28*a*–28*d* has its end connected to an electromagnetic valve device 32.

Within the electromagnetic valve device 32, a support frame 33 is fixed as shown in FIG. 3, and one end of each of the vent tubes 28*a*–28*d* is connected to the support frame 33 and is exposed to the atmosphere.

A solenoid 34 is provided in juxtaposed relationship with the support frame 33 and the rod 34*a* thereof faces the support frame 33, and a valve 35 for closing the open ends of the vent tubes 28*a*–28*d* is fixed to the end of the rod 34*a*.

Designated by 36 is a return spring.

The operation of the present embodiment constructed as described above will now be described.

All control operations are performed while the gear 24 makes one full rotation from the cap open state, i.e., the state in which the caps 22*a*–22*d* are spaced apart from the nozzle portions of the recording heads and recording is possible.

That is, the gear 23 also makes one full rotation while the gear 24 makes one full rotation, and almost in the meantime, the caps are fitted (closed) to the nozzle portions and this state is detected by a switch 31 for detecting the opening-closing of the caps.

The caps are fitted to the nozzle portions in a state in which the solenoid 34 is not operated and the open ends of the vent tubes 28*a*–28*d* are not closed (the venting state).

Subsequently, when the solenoid 34 is operated and the venting state is closed by the valve 35, the roller 29*c* of the pump lever 29 rides onto the cam 24*a* with the aid of the rotation of the gear 24 and the pump lever 29 is pivotally moved counter-clockwise as viewed in FIG. 1, and the first suction operation by the pump 26 is performed.

Subsequently, the power supply to the solenoid 34 is cut off and the valve 35 is retracted to bring about the venting state and in this state, the roller 29*c* of the pump lever 29 rides onto the other cam 24*a* and the second pump suction operation is performed.

This is the so-called idle suction, and the excess ink sucked into the caps 22*a*–22*d* is sucked toward the pump with the air in the vent tubes 28*a*–28*d*.

During the idle suction operation, the ink retained by the ink absorbers 37 in the caps and the ink adhering to the ends of the nozzles are sucked toward the pump at the same time.

The normal cap opening-closing operation is automatically effected by a timer for the purpose of preventing the drying of the nozzle portions and the adherence of dust thereto, and in a case where recording is not effected for a predetermined time, idle suction is executed in the venting state.

On the other hand, when the main switch has been closed during the normal use, after the non-recording state has continued for a predetermined time, ink is sometimes discharged preparatorily to provide a proper ink discharging state and in such case, the amount of ink in the caps becomes excessive and the ink adheres to the ends of the nozzles to cause unstable discharge or the recording paper is stained by the dripping of the excess ink when the caps are opened.

In order to prevent this, the idle suction in the venting state as previously described is effected by a command from a control device, not shown, to thereby stabilize the discharge of ink.

Also, the opening-closing of the caps is effected always in the venting state and therefore, the retraction of the meniscus of the nozzles resulting from the increase in the air pressure during the capping operation can be prevented.

Second Embodiment

Figure 4:
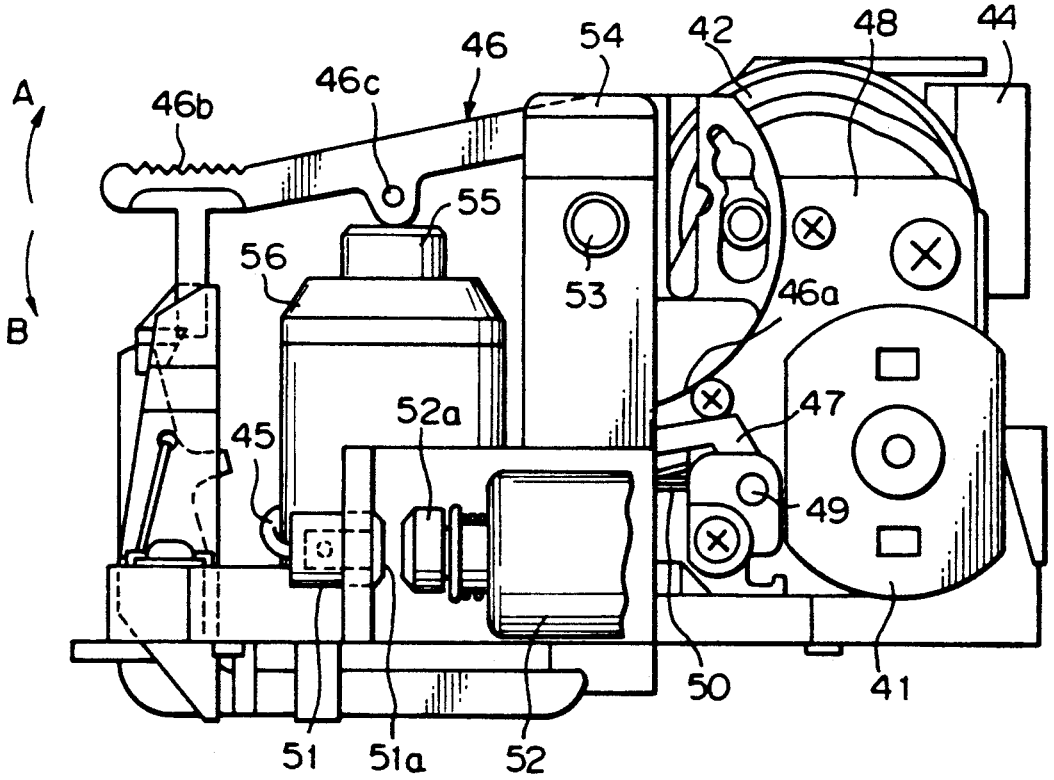
FIGS. 4 to 6 illustrate a second embodiment of the present invention, FIG. 4 being a side view, FIG. 5 being a plan view, and FIG. 6 being an illustration of an air system.

The above-described embodiment has exemplarily shown the suction recovering device for the multinozzle type liquid injection recording apparatus, while FIGS. 4 and so on show a suction recovering device wherein the number of the nozzles of the recording head is one.

In FIG. 4, reference numeral 41 designates a motor as the drive source of the suction recovering device. The revolution of this motor 41 may be transmitted to a cam gear 42. Reference numeral 44 denotes a cap which becomes opposed to the liquid injection recording head when the carriage mounting the recording head thereon is positioned in the home position H. The cap 44 has an absorber 44*a* formed, for example, of a water-absorbing porous material and joined to the nozzle portion which is the end portion of the recording head.

The cap 44 has connected thereto one end of an atmosphere opening tube 45 for letting the pressurized air in the cap escape outwardly when the nozzle portion is hermetically sealed, and a portion of the atmosphere opening tube 45 is open to the atmosphere. The opening 45*a* (see FIG. 6) of the atmosphere opening tube 45 is designed to be opened and closed by the cam surface portion 46*a* of an operating lever 46 through a vent valve 47. The vent valve 47 is supported on a support shaft 49 fixed to a support bracket 48 and is normally biased upwardly by a spring 50. Accordingly, when no extraneous force is applied to the vent valve 47, the opening 45*a* of the atmosphere opening tube 25 remains open (open to the atmosphere).

Figure 5:
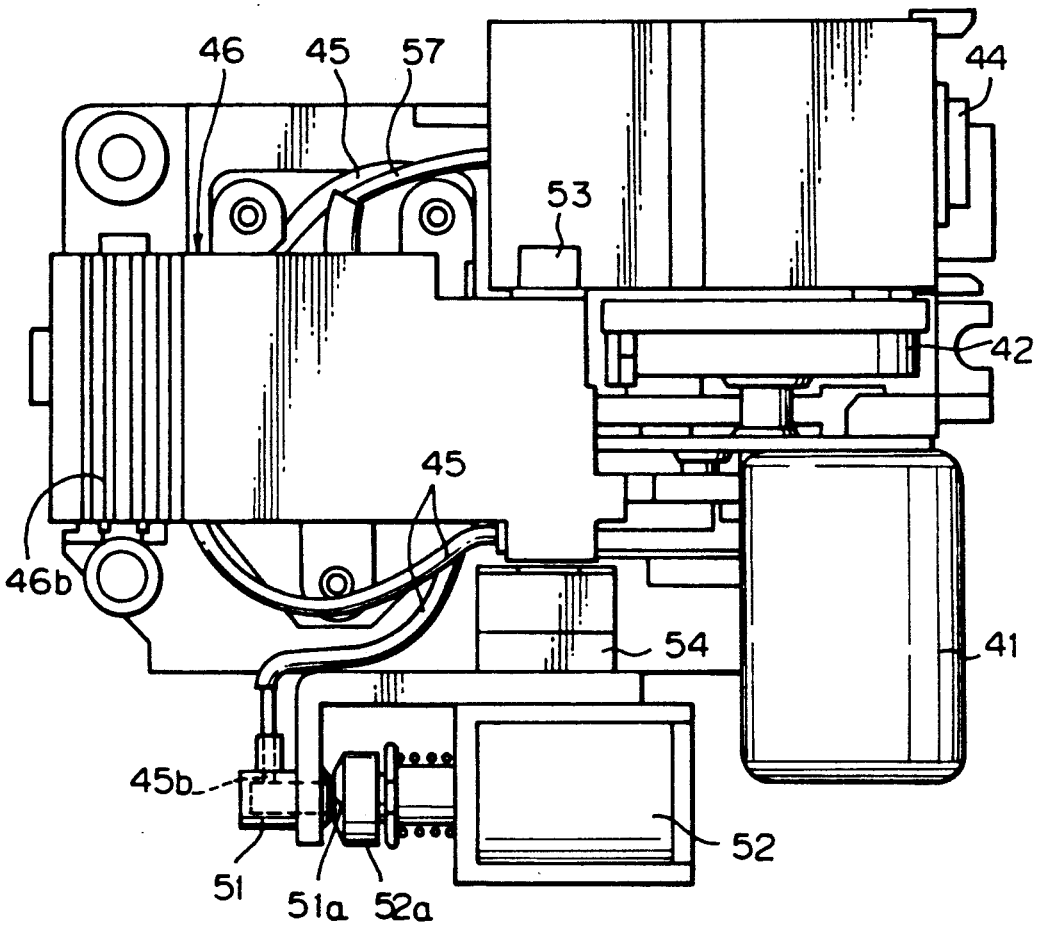
Figure 6:
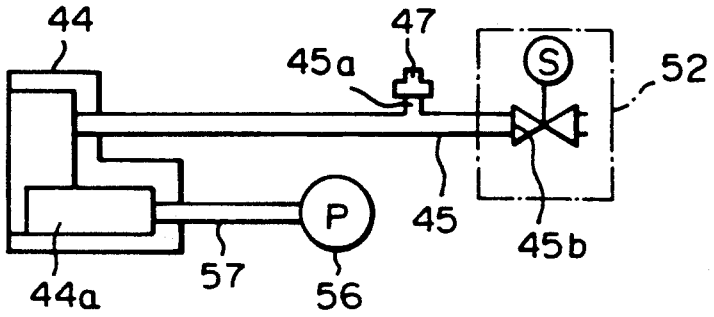

Also, as is apparent from FIGS. 5 and 6, the intermediate portion of the atmosphere opening tube 45 is open to the atmosphere and the opening 51*a* of a valve seat portion 51 connected to the opening 45*b* at the other end of the tube 45 is designed to be opened and closed by the valve portion 52*a* of an electromagnetic valve 52. That is, when the electromagnetic valve 52 is energized, the opening 51*a* is opened to the atmosphere, and when the electromagnetic valve 52 is deenergized, the opening 51*a* is closed. Also, the electromagnetic valve 52 is designed to be energized after the lapse of a predetermined time after a pump driving switch has been closed, so that the opening 51*a* of the valve seat portion 51 is opened to the atmosphere so as to permit the air to be supplied into the atmosphere opening tube 45 when the pressure in a pump 56 is negative. Accordingly, even after the pump suction operation (after the negative pressure suction), the interior of the atmosphere opening tube 45 can be maintained in the atmospheric pressure condition and the flow of the ink into the atmosphere opening pipe 45 can be eliminated. Consequently, during automatic capping, unsatisfactory discharge resulting from the retraction of the meniscus of the nozzle by the resistance of the liquid film in the atmosphere opening tube as experienced in the prior art can be reliably avoided.

Further, in order to prevent unsatisfactory discharge, the electromagnetic valve 52 at the distal end of the atmosphere opening tube 45 is energized before the capping to thereby open the tube 45 to the atmosphere.

As a result, a good discharge state can be secured even if the operator forgets to open the operating lever 46.

Also, even if the electromagnetic valve 52 is deenergized after the cap has been closed, retraction of the meniscus of the nozzle will not take place.

On the other hand, the operating lever 46 is supported on a support member 54 by a pin 53 and is pivotable about the pin 53. By pushing up the operating portion 46b of the operating lever 46 in the direction of arrow A from the position of FIG. 4, the opening 45a at the distal end of the atmosphere opening tube 45 becomes open to the atmosphere, while on the other hand, by depressing the operating portion 46b in the direction of arrow B, a piston 55 is urged by the protrusion 46c of the operating portion 46b and thus, pump suction operation is performed. A spring (not shown) for biasing the piston 55 upwardly is contained in a pump 56 which is connected to the cap 24 through a suction tube 57. That is, in response to the driving of the pump 56, ink is sucked from the nozzle portion through the absorber 44a and is further directed to the pump 56 through the suction tube 57 (see FIG. 4).

Thus, even in a case where the number of nozzles is one, if the electromagnetic valve provided at one end of the tube communicating with the atmosphere is operated and is opened to the atmosphere immediately before capping is effected, the retraction of the meniscus of the nozzle by the increase in the pressure in the cap will be prevented, and by the negative pressure suction operation being operatively associated with the electromagnetic valve, formation of a liquid film in the atmosphere opening tube can be avoided to stabilize ink discharge.

Third Embodiment

Figure 7A:
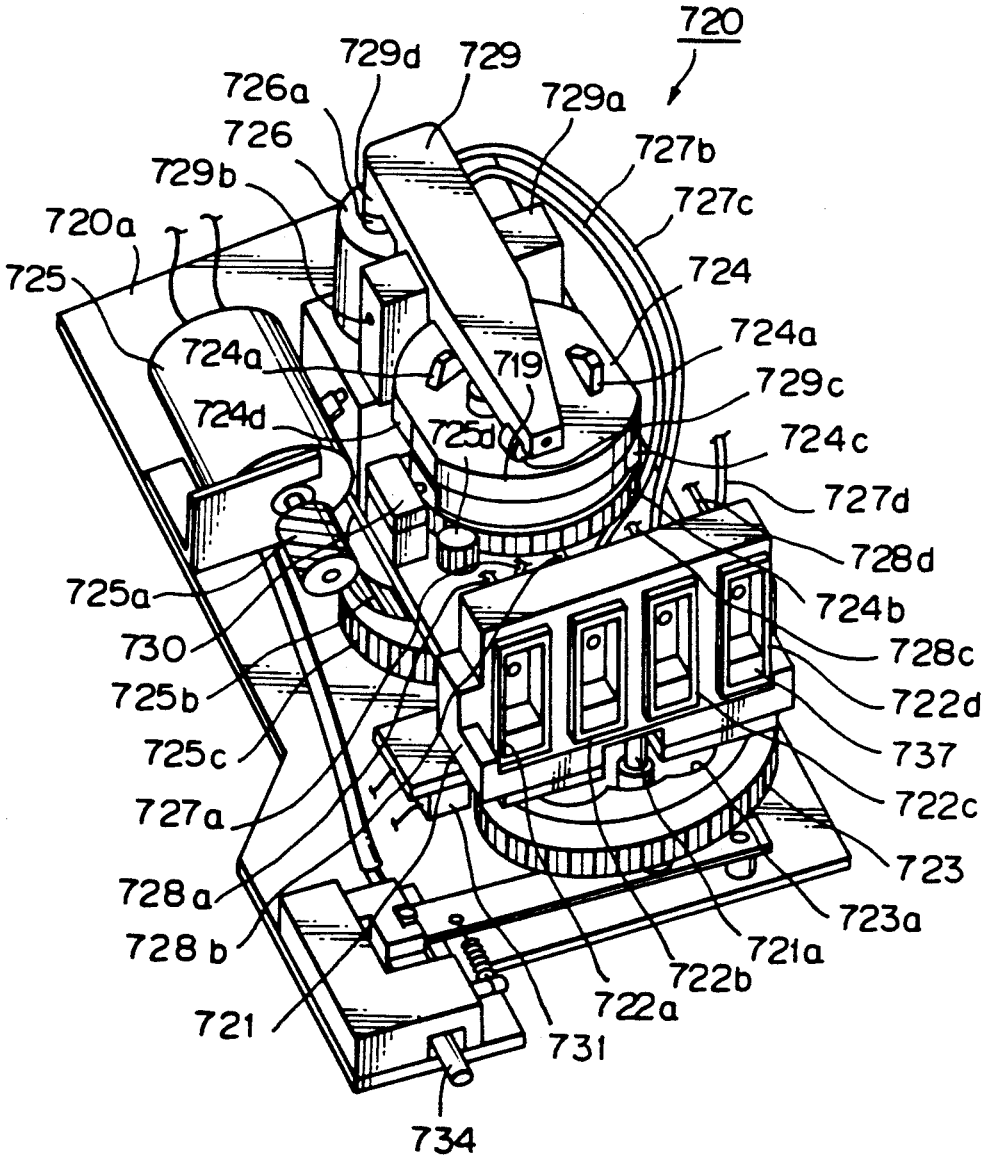
FIGS. 7A and 7B and FIG. 8 illustrate a third embodiment of the present invention, FIG. 7A being a perspective view of a suction recovering device, FIG. 7B being a plan view of the suction recovering device, and FIG. 8 being a side view of a vent opening-closing mechanism.
Figure 7B:
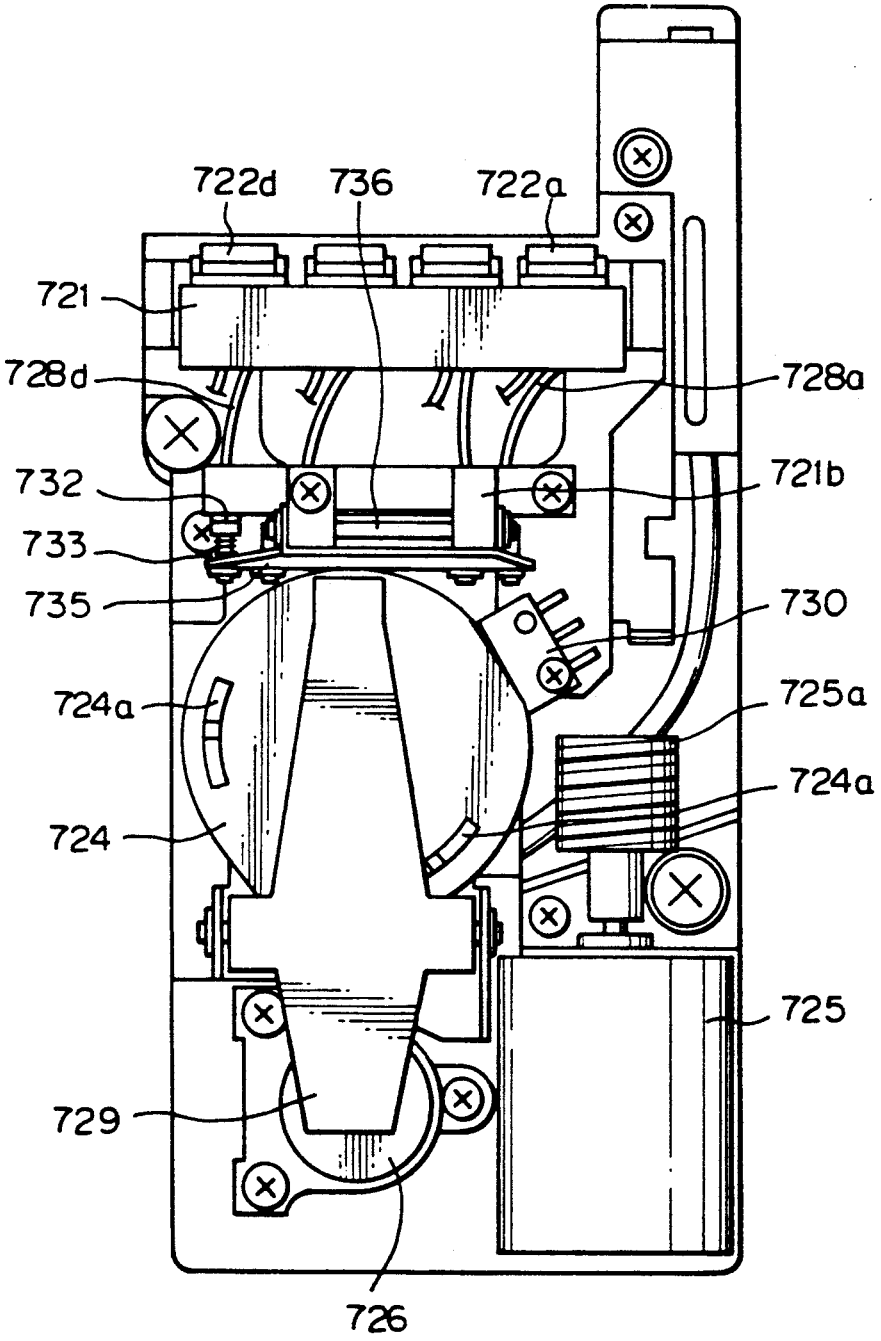

A third embodiment of the suction recovering device 20 is shown in FIGS. 7A and 7B.

The suction recovering device 20 is assembled with a base plate 720a as a standard, and a motor 725 is fixed to a portion thereof.

A pinion gear 725a fixed to the output shaft of the motor 725 is in mesh engagement with a gear 725b, and a pinion gear, not shown, which is integral with the gear 725b, is in mesh engagement with a gear 725c.

A pinion gear 725d fixed to the rotary shaft of the gear 725c is in mesh engagement with a gear 724b.

A first cam plate 724 is integrally fixed to the gear 724b, and between the first cam plate 724 and the gear 724b, a second cam plate 719 is fixed coaxially with the gear 724b.

Two trapezoidal cams 724a circumferentially spaced apart from each other by a predetermined angle are projectedly provided on the upper surface of the first cam plate 724.

Also, a cam position 724d which constitutes a vent opening-closing portion in a symmetrical state is projectedly provided on the peripheral surface of the first cam plate 724.

A cam portion 724c is projectedly provided on the peripheral surface of the second cam plate 719 also and may be detected by a detecting switch 730 comprising a microswitch or the like.

Designated by 729 is a pump lever having its intermediate portion pivotally supported on a support frame 729a projectedly provided on the base plate, through a shaft 729b.

One end of the pump lever 729 has provided thereon a roller 729c for riding onto the cam 724a projectedly provided on the first cam plate 724, and the other end of the pump lever 729 is in contact with the piston 726a of a pump 726 through a projection 729d.

The piston 726a is normally biased into its extended position by a spring provided in the pump and normally forces the roller 724c into contact with the first cam plate 724.

Denoted by 721 is a cap holder having fixed thereto a plurality of caps 722a–722d formed of an elastic material such as rubber.

An ink absorber 737 is provided in the lower portion of each of the caps 722a–722d, and these caps are discretely connected to the pump 726 through tubes 727a–727d.

The cap holder 721 is slidably provided on the base plate 720a and is normally biased away from the pump 726 by a spring, not shown.

A gear 723 is rotatably supported under the cap holder 721.

An inner face cam 723a is formed on the upper surface of the gear 723, and a shaft 721a projected from the lower end of the cap holder 721 is in contact with the inner face cam 723a through a roller.

Accordingly, with rotation of the gear 723, the cap holder 721 repeats the operation of being pushed back toward the pump 726 by the protrusion of the cam 723a.

The position of the cap holder 721 is detected by a switch 731.

On the other hand, the caps 722a–722d have ink sucking tubes 727a–727d and vent tubes 728a–728d.

Figure 8:
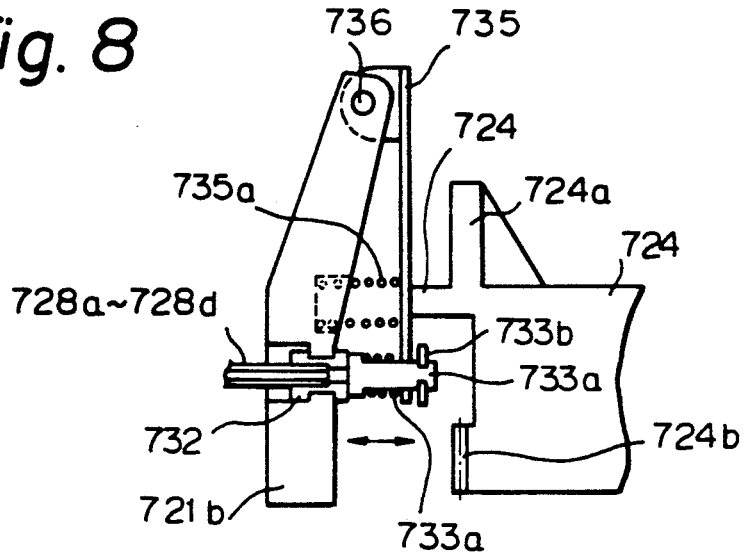

The other end of each of the vent tubes 728a–728d is fixed to a support frame 721b through a rubber plug 732, the support frame being integral with the cap holder 721 and located between the cap holder and the first cam plate 724, as shown in FIG. 8.

Also, a pivotable lever 735 has its upper end pivotally supported on the upper end of the support frame 721b through a shaft 736.

The lower end of the pivotable lever 735 is opposed to the first cam plate 724 and has a plug 733 at a position opposed to the rubber plug 732.

The pivotable lever 735 is urged toward the first cam plate 724 by a return plate 735a, and the plug 733 is urged toward the rubber plug 732 by a spring 733a and the movement thereof is controlled by a stopper 733b.

Figure 9:
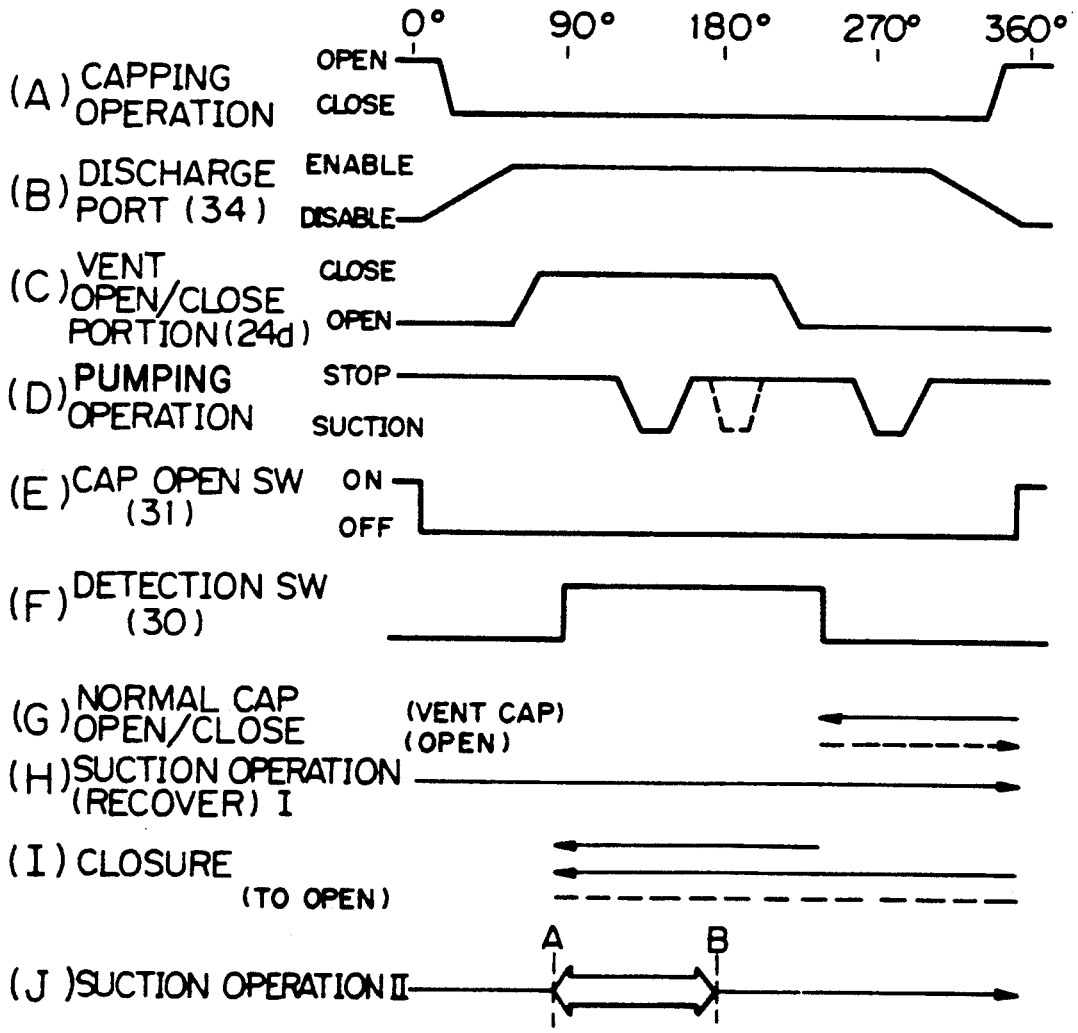
FIG. 9 is a timing chart illustrating operation of the device.

The operation of the present embodiment constructed as described above will now be described with reference to the timing chart of FIG. 9.

FIGS. 9(A)–(I) illustrate the operation timings of the respective switches, cams and other members, and as can be seen therefrom, all control operations are effected while the first and second cam plates 724 and 719 make one full rotation from the cap open state, i.e., the state in which recording is possible with the caps 722a–722d being spaced apart from the orifice portion of the recording head, not shown.

That is, the gear 723 also makes one full rotation while the first and second cam plates integral with the gear 724b make one full rotation, and almost in the meantime, the caps are in their closed state as shown in FIG. 9(A) and the switch 731 for detecting the opening-closing of the caps is in its OFF position as shown in FIG. 9(E).

The caps are secured over the orifice portion in a state in which the cam portion 724a is not in contact with the pivotable lever 735, that is, a state in which the tubes 728a–728d are in their venting state.

In a state in which as shown in FIG. 9(C), the vent is closed, that is, a state in which the cam portion 724d pushes the pivotable lever 735 and the rubber plug 732 is closed by the plug 733, the roller 729c of the pump lever 729 rides onto the cam 724a and the pump lever 729 is pivoted counter-clockwise as viewed in FIG. 7A, whereby the first suction operation by the pump 726 is effected. This state is shown in FIG. 9(D).

Soon, the cam portion 724*a* becomes separate from the pivotable lever 735 and, when the vent tubes 728*a*–728*d* become vent-open, the roller 729*c* of the pump lever 729 rides onto another cam 724*a*, whereby the second pump suction operation is effected.

This is the so-called idle suction, and the excess ink sucked into the caps 722*a*–722*d* is sucked into the pump with the air in the vent tubes 728*a*–728*d*.

As shown in FIG. 9(B), the discharge port for waste ink (designated by 734 in FIG. 7A) is in its discharging-capable state during the suction operation.

During the idle suction operation, both the ink retained in the ink absorber 737 in the caps and the ink adhering to the end of the orifice are sucked into the pump at the same time.

The normal cap opening-closing operation shown in FIG. 9(G) is automatically effected by a timer for the purpose of preventing drying of the orifice portion and the adherence of dust thereto, and is performed as idle suction in the venting portion in a case where recording is not effected for a predetermined time. Thereafter, the caps are moved by a recording command as indicated by dotted line in FIG. 9(G) and are opened, thereby bringing about the recording condition.

On the other hand, when the main switch has been closed during the normal use, after the non-recording state has continued for a predetermined time, ink is sometimes discharged preparatorily into the caps to provide a proper ink discharge state, but in such case, the amount of ink in the caps becomes excessive and ink adheres to the end of the orifice to render the discharge unstable and the recording paper is stained by dripping of excessive ink when the caps are opened.

In order to prevent this, the idle suction in the venting state as previously described is effected by a command from a control device, not shown, to thereby stabilize the ink discharge.

Also, the opening-closing of the caps takes place always in the venting state and therefore, the retraction of the meniscus of the orifice resulting from the rise of the air pressure during the capping operation can be prevented.

The suction recovering operation in the normal state as described above is the operation "I" shown in FIG. 9(H).

On the other hand, when the operation of sucking a great amount of ink at the initial stage of ink supply is to be effected, the suction operation "II" shown in FIG. 9(J) is performed.

That is, suction of a great amount of ink can be accomplished if the forward and reverse revolutions of the motor 725 are repeated between the hermetically sealed position A and the suitable position B of the vent-closed state and the pump lever 729 is pivoted a plurality of times to operate the pump 726 a plurality of times.

This operation may be effected by a timer with the point A as the reference.

For the setting of the point B, a switch may be provided, but to make the apparatus compact, timer control will suffice and it will be unnecessary to provide any special switch.

In this manner, the amount of negative pressure generated is controlled by the frequency of driving of the negative pressure generating source, whereby a large volume of negative pressure can be generated by a negative pressure generating source of small capacity.

Forth Embodiment

Figure 10:
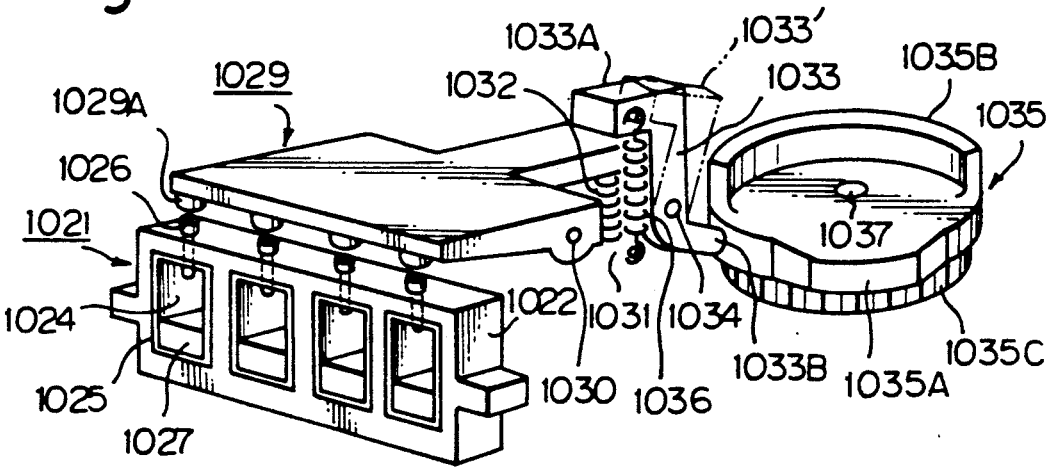
FIGS. 10 and 11 are a perspective view and a cross-sectional view, respectively, showing an example of the construction of a suction recovering device for a multicolor recording head mounted on a liquid injection recording apparatus.
Figure 11:
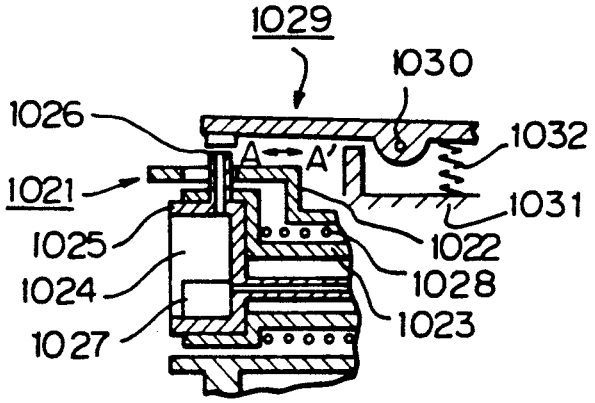

FIGS. 10 and 11 shows an example of the suction recovering device for multiple colors as the suction recovering device 20. In FIGS. 10 and 11, reference numeral 1021 designates a cap member adapted to become opposed to the liquid injection recording unit 1 when the carriage 2 is positioned in the home position H. This cap member 1021 is provided with a cap holder 1022, a cap slider 1023 disposed in the cap holder 1022 for forward and backward movement (in the directions of arrows A and A') and having attached to the rear end portion thereof a stopper ring (not shown) adapted to bear against the rear end surface of the cap holder 1022 and control any further forward movement thereof, a rubber member 1025 disposed in the forward end opening in the cap slider 1023 and keeping an internal space 1024, defined by the cap slider and the liquid injection recording unit, air-tight in the state in which it is joined with the unit 1, vent holes 1026 provided so as to extend through the upper portions of the cap slider 1023 and cap holder 1022 and formed so as to always open the internal space 1024 to the atmosphere, absorbers 1027 formed of a water-absorbing porous material, for example, and disposed in the lower portion of the rubber member 1025 and joined to the nozzle portion, and a compression spring 1028 interposed between the cap holder 1022 and the cap slider 1023 and adapted to be compressed by a pressure force when the rubber member 1025 is pressed rearwardly.

Reference numeral 1029 denotes a vent opening-closing lever pivotally supported on a lever shaft 1030 and opening and closing the vent holes 1026. Rubber members 1029A corresponding to the vent holes 1026 and opening and closing these vent holes are provided on the underside of the fore end of the vent opening-closing lever 1029. The vent opening-closing lever 1029 is normally biased counter-clockwise (in a direction to close the vent hole 1026) by a return spring 1032 interposed between the rear end thereof and a base plate 1031. Reference numeral 1033 designates a lock member pivotally supported on a shaft 1034 and formed substantially in the shape of a crank. The upper end portion 1033A of this lock member 1033 is formed for engagement and disengagement with the rear end portion of the vent opening-closing lever 1029 (dots-and-dash line 1033' indicates the disengaged state), and the lower end portion 1033B of the lock member 1033 is in engagement with the cam surface 1035A of a vent cam 1035 and is designed to be operated following this cam surface 1035A. A lock member spring 1036 is extended between the upper end portion 1033A of the lock member 1033 and the base plate 1031, and the lock member 1033 is normally bised counter-clockwise (in a direction in which the upper end portion 1033 of the lock member 1033 tries to engage the rear end portion of the vent opening-closing lever 1029) by the resiliency of the lock member spring 1036.

Although not shown, a cap opening switch and a cap closing switch adapted to be actuated by the cam surface 1035A of the vent cam 1035 are provided at predetermined locations on the cam surface 1035A. These cap opening and cap closing switches are designed such that as shown in FIG. 12, the cap closing switch is closed after the lapse of a predetermined time ($TC_1$) after the cap opening switch is opened.

Further, a cam surface 1035B is provided also on the upper portion of the vent cam 1035, and a suction recovering operation lever (not shown) for driving a pump (not shown) is designed to be operated following the displacement of this cam surface 1035B. The vent cam 1035 is rotatably supported on a shaft 1037 and is designed to be rotated by the revolution of a drive motor, not shown, being transmitted to a gear portion 1035C through a gear train. The pump and the cap member 1021 are connected together through a suction tube (not shown) so that in response to the driving of the pump, ink is sucked from the nozzle portion through the absorbers 1027 and is further directed to the pump through the suction tube.

Figure 12:
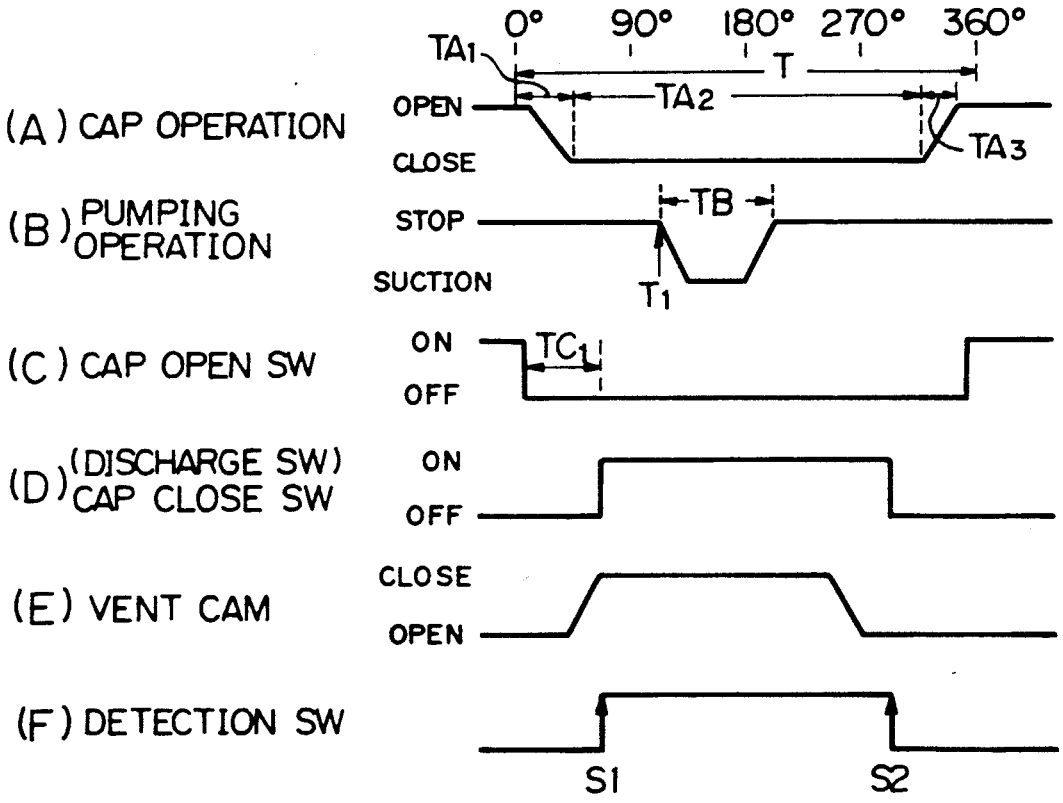
FIG. 12 is a timing chart showing the operation timings of various portions of the suction recovering device shown in FIGS. 10 and 11.

FIG. 12 shows the operation timings of the various portions of the suction mechanism. In FIG. 12, the displacement curve (A) of the cap member 1021 and the curve (B) indicating the operation of the pump correspond to the outline curves, respectively, of the cam surface of a cam for moving the cap member forward and backward and the cam surface 1035B of the vent cam 1035.

Also, the period T corresponds to one full rotation (360°) of the cam for moving the cap member forward and backward and of the vent cam 1035.

In FIG. 12(A), the period $TA_1$ is a period during which cap member 1021 is moved toward the nozzle portion in response to the rotation of the cam for moving the cap member forward and backward. In the process of this movement, the cap opening switch is opened as shown in FIG. 12(C), and further, the cap closing switch is closed in a predetermined time ($TC_1$) after the cap opening switch has been opened.

The period $TA_2$ is a period during which the cap member 1021 is in contact with the nozzle portion and the flowpath of ink from the nozzle portion to the pump is opened. Also, at a time $T_1$, driving of the pump is effected by the displacement of the cam surface 1035B of the vent cam 1035. In one stroke comprising a period TB during which the suction discharge operation from the time $T_1$ is effected, the cap member 1021 is closed and therefore, the ink from the nozzle portion is sucked and discharged into a waste ink receiving portion. Also, the period $TA_3$ after such suction and discharge is a period during which the cap member 1021 becomes separate from the carriage 2 side, and in this process of separation, the cap opening switch is closed.

The vent cam 1035, as shown in FIG. 12(E), maintains its closed state (that is, the state in which) the vent hole 1026 is closed) only before and after the pump suction operation (the suction recovering operation) is effected after the caps have become hermetically sealed, and is in its opened state (the state in which the vent hole 1026 is opened) at other times.

In FIG. 12(F), $S_1$ indicates the hermetically sealed cap position when the drive motor is revolved, for example, in a forward direction, and $S_2$ indicates the atmosphere communicated cap position when the drive motor is revolved in a reverse direction. Upon arrival of a cap opening signal such as a print signal, the drive motor revolves in a forward direction and print becomes possible with the cap opening switch being closed. Also, upon arrival of a suction signal and only when the drive motor is stopped at a position specially indicated during transportation, the vent cam closed state is brought about and the vent cam 1035 moves in the direction of 0°→360° during the suction recovery until the cap opening switch is closed. The vent cam 1035 moves in the range of the detected position of $S_2$ and 360° during the normal capping operation.

I claim:

1. A suction recovering device in a liquid jet recording apparatus provided with liquid jet recording means for discharging ink to the recording surface of a recording medium and effecting recording thereon and a cap member opposed to said liquid jet recording means in a predetermined position, comprising:

vent opening-closing means for opening and closing a vent hole provided in said cap member;

first biasing means for normally biasing said vent opening-closing means in a direction to close said vent hole;

lock means for engagement and disengagement with said vent opening-closing means and controlling the vent hole opening-closing of said vent opening-closing means;

second biasing means for normally biasing said lock means in a direction to engage said vent opening-closing means; and operating means for operating said lock means into engagement and disengagement with said vent opening-closing means, said vent hole being closed by the operation of said operating means only during transportation and during a negative pressure suction recovering operation.

2. A suction recovering device according to claim 1, wherein said suction recovering device is provided in a liquid jet recording apparatus and said liquid jet recording means comprises a liquid jet recording head.

3. A discharge recovery device for an ink jet recording apparatus including a plurality of recording heads, each having a discharge port for discharging ink therethrough, the device comprising:

capping means integrally provided with a plurality of caps, each said cap being disposed for covering said discharge port of a corresponding recording head;

suction means, communicating with each said cap at a predetermined position of said cap, for sucking ink from said discharge port through said cap; and vent means for opening and closing the interior of said caps to the atmosphere, said vent means having a vent tube communicating with each said cap at a position different from the position where said suction means communicates with said cap, wherein said vent means communicates the interior of said caps with the atmosphere a predetermined time period after the initiation of suction by said suction means.

4. A discharge recovery device according to claim 3, wherein said vent means includes a solenoid for communicating the interior of said caps with the atmosphere a predetermined time period after initiation of suction by said suction means.

5. A discharge recovery device according to claim 3, wherein said vent means includes a valve for interrupting communication between the interior of said caps and the atmosphere when said suction means is sucking and a solenoid for communicating the interior of said caps with the atmosphere a predetermined time period after initiation of suction by said suction means.

6. A discharge recovery device according to claim 3, wherein an ink absorbing member is disposed in each said cap.

7. A discharge recovery device according to claim 6, wherein said ink absorbing member is provided at a section of said caps that communicates with said suction means.

8. A discharge recovery device according to claim 3, wherein said caps are formed of an elastic material and said capping means is arranged in such a manner that said plurality of caps are integrally provided on a movable cap holder.

9. A discharge recovery device according to claim 3, wherein said discharge recovery device is provided on a substrate together with a driving source for driving said device.

10. An ink jet recording apparatus comprising:

a plurality of recording heads, each having a discharge port for discharging ink therethrough;

conveying means for conveying a recording sheet;

capping means integrally provided with a plurality of caps, each said cap being disposed for covering said discharge port of a corresponding recording head;

suction means, communicating with each said cap at a predetermined position of said cap, for sucking ink from said discharge port through said cap; and vent means for opening and closing the interior of said caps to the atmosphere, said vent means having a vent tube communicating with each said cap at a position different from the position where said suction means communicates with said cap, wherein said vent means communicates the interior of said caps with the atmosphere a predetermined time period after the initiation of suction by said suction means.

11. An ink jet recording apparatus according to claim 10, wherein said vent means includes a solenoid for communicating the interior of said caps with the atmosphere a predetermined time period after initiation of suction by said suction means.

12. An ink jet recording apparatus according to claim 10, wherein said vent means includes a valve for interrupting communication between the interior of said caps and the atmosphere when said suction means is sucking and a solenoid for communicating the interior of said caps with the atmosphere a predetermined time period after initiation of suction by said suction means.

13. An ink jet recording apparatus according to claim 11, wherein said ink absorbing member is provided at a section of each said cap that communicates with said suction means.

14. An ink jet recording apparatus according to claim 10, wherein an ink absorbing member is disposed in each said cap.

15. An ink jet recording apparatus according to claim 10, wherein said recording heads include an electrothermal converting element for generating energy to discharge ink.

16. An ink jet recording apparatus according to claim 10, wherein said recording heads include an electromechanical converting element for generating energy to discharge ink.

17. An ink jet recording apparatus according to claim 10, wherein said plurality of recording heads are provided in accordance with ink colors.

18. An ink jet recording apparatus according to claim 10, wherein said plurality of recording heads comprise four recording head units.

19. An ink jet recording apparatus according to claim 10, wherein said caps are formed of an elastic material and said capping means is arranged in such a manner that said plurality of caps are integrally provided on a movable cap holder.

20. An ink jet recording apparatus according to claim 10, wherein said vent means includes a discharge recovery device provided on a substrate together with a driving source for driving said device.

21. A discharge recovery method for recovering discharge in an ink jet recording apparatus having a plurality of recording heads each having a discharge port for discharging ink therethrough, by utilizing a discharge recovery device, said device comprising:

capping means integrally provided with a plurality of caps, each said cap being disposed for covering said discharge port of a corresponding recording head;

suction means communicating with each said cap at a predetermined position to suck ink from said discharge port through said cap; and vent means for opening and closing the interior of said caps to the atmosphere, said vent means having a vent tube communicating with each said cap at a position different from the position where said suction means communicates with said cap, wherein the method comprises the steps of:

covering said discharge ports with said caps;

sealing said caps from the atmosphere using said vent means and sucking ink through said caps from said discharge ports using said suction means;

communicating the interior of said caps with the atmosphere a predetermined time period after the initiation of suction by said suction means; and uncovering said discharge ports.

22. A method according to claim 21, wherein said sucking step is performed during said communicating step.

23. A method according to claim 21, wherein said sealing and sucking steps are repeated a plurality of times.

24. An ink jet recording apparatus comprising:

a plurality of recording heads, each having a discharge port for discharging ink therethrough;

a conveying means for conveying a recording sheet;

a cap holder integrally provided with a plurality of caps, each cap being disposed for covering said discharge port of a corresponding recording head;

suction means communicating with each said cap at a predetermined position for sucking ink from said discharge port through said caps, wherein said suction means is operable in a first mode in which said suction means is driven a predetermined number of times and a second mode in which said suction means is driven a number of times larger than said predetermined number; and vent means for opening and closing the interior of said caps to the atmosphere, said vent means having a vent tube communicating with each said cap at a position different from the position where said suction means communicates with said cap, wherein said vent means communicates the interior of said caps with the atmosphere a predetermined time period after the initiation of suction by said suction means.

25. An ink jet recording apparatus according to claim 24, wherein said recording heads include an electrothermal converting element for generating energy to discharge ink.

26. An ink jet recording apparatus according to claim 24, wherein said recording heads include an electromechanical converting element for generating energy to discharge ink.

27. An ink jet recording apparatus according to claim 24, wherein said plurality of recording heads are provided in accordance with ink colors.

28. An ink jet recording apparatus according to claim 24, wherein said conveying means comprises a conveying roller.

29. An ink jet recording apparatus comprising:

conveying means for conveying a recording sheet;

liquid jet recording means for discharging ink to the recording surface of a recording medium and effecting recording thereon;

a cap member opposed to said liquid jet recording means in a predetermined position;

vent opening-closing means for opening and closing a vent hole provided in said cap member;

first biasing means for normally biasing said vent opening-closing means in a direction to close said vent hole;

lock means for engagement and disengagement with said vent opening-closing means and controlling the vent hole opening-closing of said vent opening-closing means;

second biasing means for normally biasing said lock means in a direction to engage said vent opening-closing means; and operating means for operating said lock means into engagement and disengagement with said vent opening-closing means, said vent hole being closed by the operation of said operating means only during transportation and during a negative pressure suction recovering operation.

30. An ink jet recording apparatus according to claim 29, wherein said liquid jet recording means comprises a liquid jet recording head.

31. An ink jet recording apparatus according to claim 29, wherein said vent opening-closing means includes a solenoid.

32. An ink jet recording apparatus according to claim 29, wherein said conveying means comprises a conveying roller.

33. An ink jet recording apparatus according to claim 29, wherein an ink absorbing member is disposed in said cap member.

34. An ink jet recording apparatus according to claim 29, wherein said recording means comprises a liquid jet recording head including an electro-thermal converting element for generating energy to discharge ink.

35. An ink jet recording apparatus according to claim 29, wherein said recording means comprises a liquid jet recording head including an electro-mechanical converting element for generating energy to discharge ink.

36. An ink jet recording apparatus according to claim 29, wherein said liquid jet recording means comprises a plurality of liquid jet recording heads provided in accordance with ink colors.

37. An ink jet recording apparatus according to claim 29, wherein said liquid jet recording means comprises four recording head units.

38. An ink jet recording apparatus according to claim 29, wherein said cap member is formed of an elastic material and is arranged in such a manner that said cap member is integrally provided on a movable cap holder.

39. An ink jet recording apparatus according to claim 29, where said vent opening-closing means includes a discharge recovery device provided on a substrate together with a driving source for driving said device.

40. A discharge recovery device for an ink jet recording apparatus including a plurality of recording heads, each having a discharge port for discharging ink therethrough, the device comprising:

a cap holder integrally provided with a plurality of caps, each cap being disposed for covering said discharge port of a corresponding recording head;

suction means communicating with each said cap at a predetermined position for sucking ink from said discharge port through said caps, wherein said suction means is operable in a first mode in which said suction means is driven a predetermined number of times and a second mode in which said suction means is driven a number of times larger than said predetermined number; and vent means for opening and closing the interior of said caps to the atmosphere, said vent means having a vent tube communicating with each said cap at a position different from the position where said suction means communicates with said cap, wherein said vent means communicates the interior of said caps with the atmosphere a predetermined time period after the initiation of suction by said suction means.

41. A discharge recovery device according to claim 40, wherein said recording heads include a electro-thermal converting element for generating energy to discharge ink.

42. A discharge recovery device according to claim 40, wherein said recording heads include an electro-mechanical converting element for generating energy to discharge ink.

43. A discharge recovery device according to claim 40, wherein said plurality of recording heads are provided in accordance with ink colors.

44. A discharge recovery device according to claim 40, wherein said vent means includes a solenoid for communicating the interior of said caps with the atmosphere a predetermined time period after the initiation of suction by said suction means.

45. A discharge recovery device according to claim 40, wherein said vent means includes a valve for interrupting communication between the interior of said caps and the atmosphere when said suction means is sucking and a solenoid for communicating the interior of said caps with the atmosphere a predetermined time period after initiation of suction by said suction means.

46. A discharge recovery device according to claim 48, wherein an ink absorbing member is disposed in each said cap.

47. A discharge recovery device according to claim 46, wherein said ink absorbing member is provided at a section of said caps that communicates with said suction means.

48. A discharge recovery device according to claim 45, wherein said caps are formed of an elastic material and said cap holder is movable.

49. A discharge recovery device according to claim 40, wherein said discharge recovery device is provided on a substrate together with a driving source for driving said device.

* * * * *

UNITED STATES PATENT AND TRADEMARK OFFICE

CERTIFICATE OF CORRECTION

PATENT NO. : 5,086,305

DATED : February 4, 1992

INVENTOR(S) : Koji Terasawa

It is certified that error appears in the above-identified patent and that said Letters Patent is hereby corrected as shown below:

IN [57] ABSTRACT

Line 5, "head" should read --head,--.

COLUMN 1

Line 8, "which" should read --now abandoned, which--.

COLUMN 3

Line 56, "members" should read --member--.
Line 57, "members." should read --member.--.

COLUMN 6

Line 31, "25" should read --45--.

COLUMN 7

Line 13, "24" should read --44--.
Line 50, "position" should read --portion--.

COLUMN 8

Line 1, "724c" should read --729c--.

COLUMN 10

Line 4, "Forth" should read --Fourth--.
Line 41, "hole" should read --holes--.
Line 56, "bised" should read --biased--.
Line 57, "1033" should read --1033A--.

UNITED STATES PATENT AND TRADEMARK OFFICE

CERTIFICATE OF CORRECTION

PATENT NO. : 5,086,305

DATED : February 4, 1992

INVENTOR(S) : Koji Terasawa

It is certified that error appears in the above-identified patent and that said Letters Patent is hereby corrected as shown below:

COLUMN 11

Line 49, "which)" should read --which--.
Line 50, "hole 1026 is" should read --holes 1026 are--.
Line 54, "hole 1026 is" should read --holes 1026 are--.

COLUMN 13

Line 45, "11," should read --14,--.

COLUMN 14

Line 42, "a" (first occurrence) should be deleted.

COLUMN 16

Line 30, "a" should read --an--.

Signed and Sealed this

First Day of June, 1993

*Attest:*

Michael K. Kirk

MICHAEL K. KIRK

*Attesting Officer*

*Acting Commissioner of Patents and Trademarks*